US005938150A

United States Patent [19]

King

[11] Patent Number: 5,938,150

[45] Date of Patent: Aug. 17, 1999

[54] KITE WITH AN ADJUSTABLE AIRFOIL AND REMOVABLE SURFACE

[76] Inventor: Randy J. King, 706 S. Longmont Ave., Lafayette, Colo. 80026

[21] Appl. No.: 08/896,582

[22] Filed: Jul. 18, 1997

Related U.S. Application Data

[63] Continuation of application No. 08/549,086, Oct. 27, 1995, abandoned.

[51] Int. Cl.[6] ..... B64C 31/02

[52] U.S. Cl. ..... 244/153 R; 244/155 R

[58] Field of Search ..... 244/153 R, 155 R, 244/155 A; 446/94, 95, 34

[56] References Cited

U.S. PATENT DOCUMENTS

| | | | |
|---|---|---|---|
| 1,014,369 | 1/1912 | Buengers | 244/153 R |
| 2,170,771 | 8/1939 | Benjamin | 446/126 |
| 2,484,096 | 10/1949 | Kay | 244/153 R |
| 3,018,075 | 1/1962 | Bowers | 244/153 R |
| 3,194,520 | 7/1965 | Kurkjian | 244/153 R |
| 3,279,726 | 10/1966 | Mindiola | 244/153 R |
| 3,514,059 | 5/1970 | Aalto | 244/153 R |
| 3,612,450 | 10/1971 | Sinka | 244/153 R |
| 3,920,201 | 11/1975 | Battles | 244/153 R |

*Primary Examiner*—Charles T. Jordan
*Assistant Examiner*—Tien Dinh
*Attorney, Agent, or Firm*—Emery L. Tracy

[57] ABSTRACT

A kite having an adjustable airfoil to maintain a multisided surface material in a flying position has a surface material or sheet requiring no modifications and may be easily removed. The surface material may also be modified for more permanent assembly.

8 Claims, 4 Drawing Sheets

KITE WITH AN ADJUSTABLE AIRFOIL AND REMOVABLE SURFACE

This is a continuation of Ser. No. 08/549,086 filed Oct. 27, 1995 and abandoned.

BACKGROUND OF THE INVENTION

1. Field of the Invention

The present invention is generally directed to a kite having an adjustable airfoil to maintain large unmodified and removable surface materials in a flying position.

2. Description of the Prior Art

Kites of various designs have been used by people for centuries. A kite fundamental design includes a surface material fastened on a frame. All the surface materials use peripheral support by strings or cords maintained inside a surface material fold such as in U.S. Pat. Nos. 225,306; 1,014,369; 1,480,889; 1,781,662; 2,613,895; 3,018,075; 3,327,975; or side struts in U.S. Pat. Nos. 4,072,284 and 5,064,149. None of these designs can use any surface material, such as a flag, school or sports banner, advertising, or any material to be temporarily attached to a kite frame without damage to the surface material or modifications to provide peripheral support. Most kites do not have the ability to adjust to various surface material shapes or provide temporary means for mounting on a kite frame. Also many of these kites do not have the lifting ability provided by an adjustable airfoil to fly large sizes or heavy weights.

SUMMARY OF THE INVENTION

The invention is a kite having an adjustable airfoil to maintain large unmodified and removable surface material in a flying position. The frame preferably consists of three frame members, two members connecting diagonal corners of a square, rectangular or multisided surface material. A removable clamp means attached to the frame ends and the surface material maintains the surface material shape. A third frame member, located at the diagonal frame members crossing point, centrally connects the top and bottom of the surface material by removable clamps attached to this member. A centrally located hub means for connecting frame members at the crossing point of the three frame members connects the members while providing an upward perpendicular projection means for producing an airfoil shape in the surface material to aid in flying. The projection length controls the shape and depth of the airfoil and the hub location positions the airfoil. A long thin cord means in tension for producing an airfoil shape curvature of the frame is diagonally connected to each clamp and crosses on top of the perpendicular projection. A bridle with strings on the opposing side of the frame controls the kite and permits unobstructed view of any imprint on the surface material. A optional fourth frame member across the bottom and attached to the clamps provides a means for attaching a kite tail.

The removable feature of the kite's surface material allows changing of messages or depictions, replacing torn surface materials, the ability to clean the surface materials, and easy storage and assembly. This feature also permits flying of any size of surface material by adjustment of frame lengths. The surface material may also be modified for more permanent clamping or fastening means for maintaining a flying form.

Accordingly, an object of the invention is to provide a kite that has an easily installed or removed surface material that requires no modifications.

Another object of the invention is to provide a means for displaying advertising for products or sports emblems to a large number of viewers.

Another object of the invention is to provide an airfoil design for a kite that results in easy lift of large kites.

Another object of the invention is to provide an entertaining means to display a variety of depictions or images to many people.

DETAILED DESCRIPTION OF THE PREFERRED AND OTHER EMBODIMENTS

Figure 1:
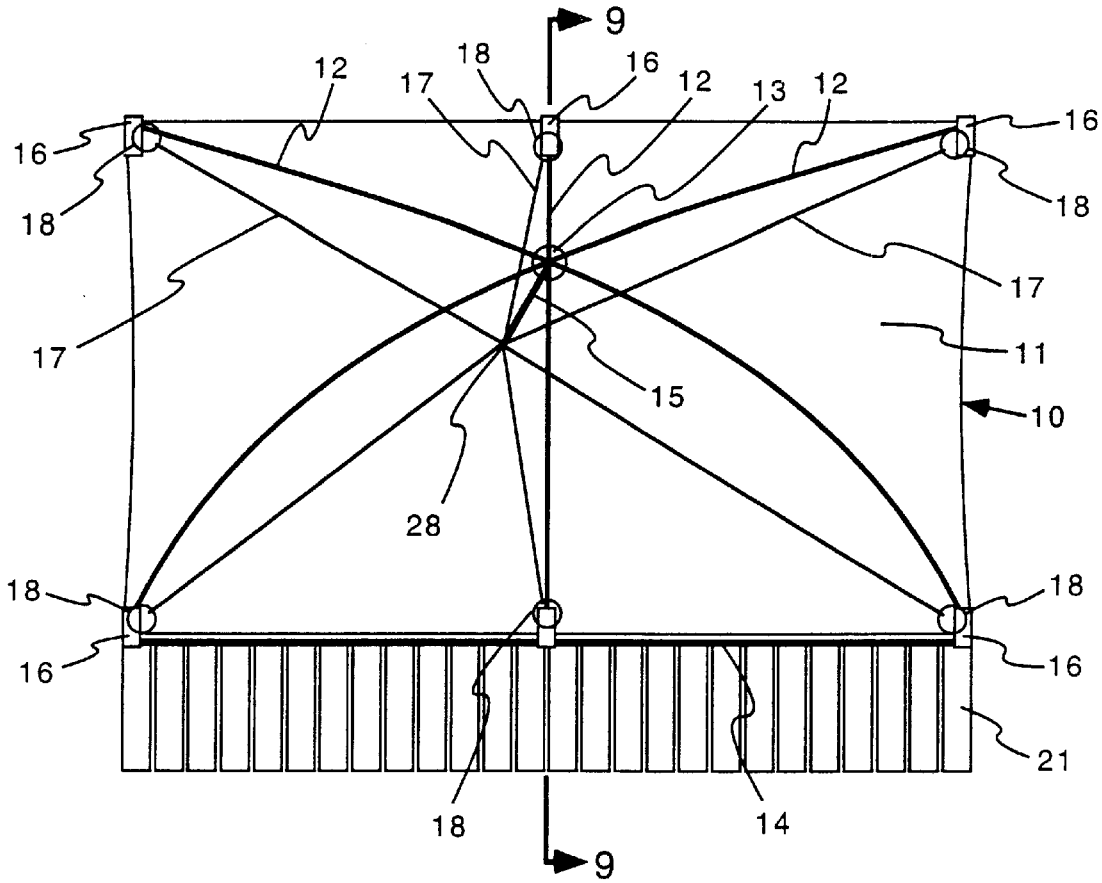
FIG. 1 is a top perspective view of a kite having a frame and surface material formed in an airfoil shape.
Figure 9:
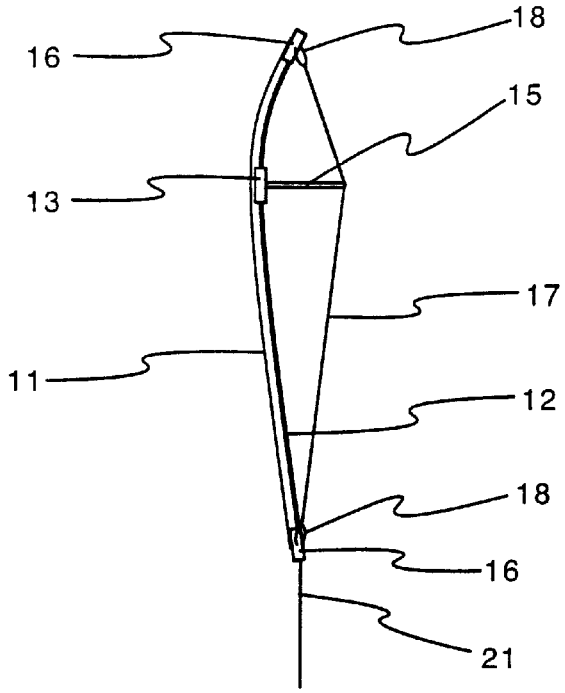
FIG. 9 is a cross-sectional view through center frame member within the kite taken along line 9—9 of FIG. 1.

FIG. 1 is a top perspective view of the kite 10 having a multisided material means 11 for forming a flying surface and a frame member means 12 for maintaining a flying surface shape or form and connected to diagonally opposing corners and upper and lower centers. A hub means 13 for joining the frame members in a desired central position is located at the frame members crossing point. A means 16 for joining and maintaining the material means shape is attached to the end of each frame member means. The means for joining and attaching hold the flying surface in contact with the frame means with no damage or modification to the surface material means. The hub means 13 for connecting the frame members at the crossing point of the frame members provides an upward protrusion or projection means 15 from a flying kite for forming an airfoil shape of the surface material means preferably in an approximate perpendicular projection to the frame means. This projection means may be constructed from a frame member material and may be a separate structure, an integral part of the hub means, or any shape to produce a projection. The length of the projection controls the shape of the airfoil. The longer the length, the more curvature in the airfoil is produced. The location of the hub means along the upper and lower center line of the flying kite positions the location of the airfoil.

A means for joining and maintaining the material means shape 16 is attached to the end of each frame member means. Preferably the material means are maintained between the jaws of the clamp without damage to the material means. If desired, modification to the periphery of the material means may be made, but this is not necessary for the present invention's preferred embodiment. This modification may include eyelets in the material or frame member means, sewed narrow laces for tying to frame member means ends, and clamps that lock into mating connections.

The means for joining and maintaining the material means for forming a flying surface to the frame member means may be manufactured from plastic or metal and include clamps that maintain flat or folded material means. More permanent fastening means include nuts and bolts, lever operated fasteners, u-shaped bolts, riveted, sewed, or bonded devices.

A plurality of long thin connecting means 17 for forming an airfoil shape of the frame are diagonally connected in tension to a pair of clamps and each crosses on top of the perpendicular projection. The greater the tension, the larger the shape and height of the airfoil. The airfoil height should range between about 10% to 90% of the height of the projection depending upon the size and weight of the kite and wind conditions. A groove or opening means 28 for maintaining the connecting means is located on the top of the projection. An adapter means 18 for fastening the long thin connecting means to the clamp means may be used. The adapter means is firmly attached to the connecting means ends and to the means for clamping. These adapter means include key rings, swivels normally used for fish hook attachments to fishing lines, spring locking devices and paper clips or the like. The long thin connecting means include lines, cords, strings, twines, wires, and cables made from thermosetting plastics or thermoplastics including polyester, nylon, and metal or natural fiber materials.

An optional frame member means 14 for attaching a tail and a tail 21 is located on the bottom of the assembled frame. The tail may be multistrands or single length of material means of weight and size to balance the size and weight of the kite assembly 10 for controlled flight. A tail may be attached directly to the surface material means.

The material means for forming a surface 11 may be a multisided surface with a rectangle shape being preferred. The surface material means may be fabricated from sheets of natural or synthetic cloth, paper, plastic, or combinations of these materials. Nylon materials are preferred with desired emblems, advertising, flags, or designs being imprinted, attached by adhesives, or silk screened painted may be applied on the surface material. Preferably, the material means is flexible. However, thin rigid surface materials that may be formed into proper airfoil shapes may be used.

The frame member means 12 for maintaining a flying surface may have a cross section shape of solid or hollow round, square, rectangular shapes or tee, I, C, or the like open shapes. Preferred materials are plastic with carbon or glass reinforcing for strength and light weight although metal or other thermosetting plastics and thermoplastics may be used such as polyester, polypropylene, nylon, or ABS. Wood and metals may also be used. The frame means may be single length passing through the hub or sections fit into the hub. Lengths are determined by the size of the material surface means and telescoping sections that lock in a desired position may be used. Ideally, the frame members means will bend under tension forming an arc. The short frame member means in front of the hub may be specially shaped to form an air foil.

Figure 2:
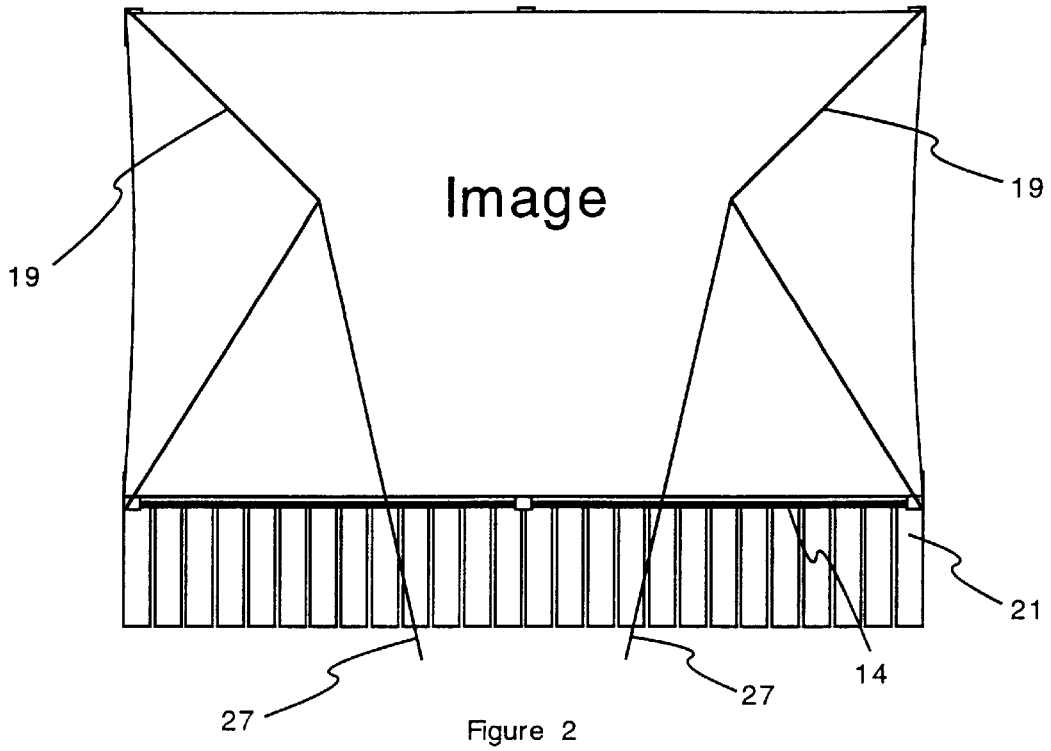
FIG. 2 is a bottom perspective view of the bridle means on the kite.

FIG. 2 shows the bottom, visible section of the flying kite using a the bridle means 19 for controlling and flying the kite. A bridle means is formed below the surface material means that is the opposing side of the frame. The bridle means is attached to the corners of the frame means and centrally connects to single control line or double lines 27 to a person flying the kite. This permits unobstructed view of any imprint on the surface material. The bridle and control line are constructed from the same materials as the long thin connecting means for forming an airfoil shape. The bridle is attached to the corners of the kite and the four extension lines terminate in a single line from the kite to an operating person or each of the two side extensions terminate in double lines to the operator for more control of the kite such as producing stunts. The bridle is positioned on the kite side opposing frame member means. The bridle and control lines may be constructed from the same materials as the long thin connecting means.

Figure 3:
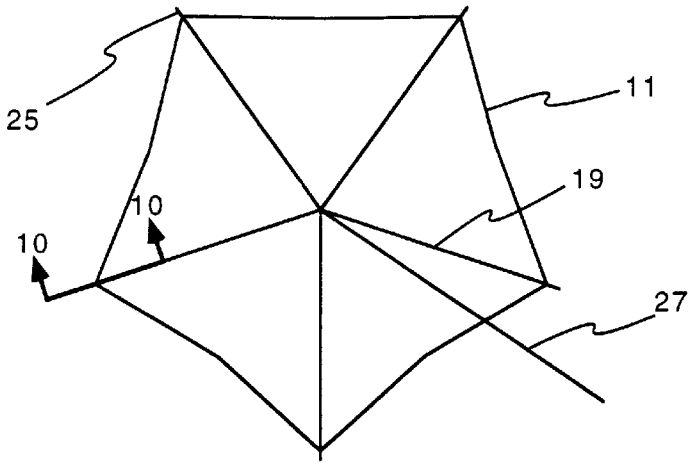
FIG. 3 is a bottom view of a multisided kite frame having sides greater than four having hemmed edges enclosing a thin connecting means to support the surface material peripheral edge.
Figure 10:
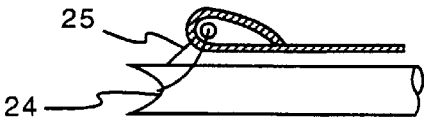
FIG. 10 is a cross-sectional view through a multisided kite frame member end taken along the line 10—10 in FIG. 3.

FIG. 3 shows the bottom view of a multisided kite having five sides. If desired, more sides are possible and may require additional diagonal positioned frame member means. This figure shows another embodiment of the invention that includes the surface member means positioned as previously described, a hub means for producing an airfoil as previously described, and long thin connecting means in tension for producing an airfoil shape curvature of the frame. A means 24 in the ends of the surface member means for retaining an additional long thin connecting means 25 either rigid or flexible is imbedded in a peripheral seam around the periphery of the material means for maintaining a flying surface. The retaining means includes notches, loops, circles, or wires that retain the long thin connecting means. Other means for securing the surface member having peripheral support to the ends of the frame means are clamps, nuts and bolts, and ties or similar mechanisms to fasten frame member means to modified surface member means for attachment.

Figure 4:
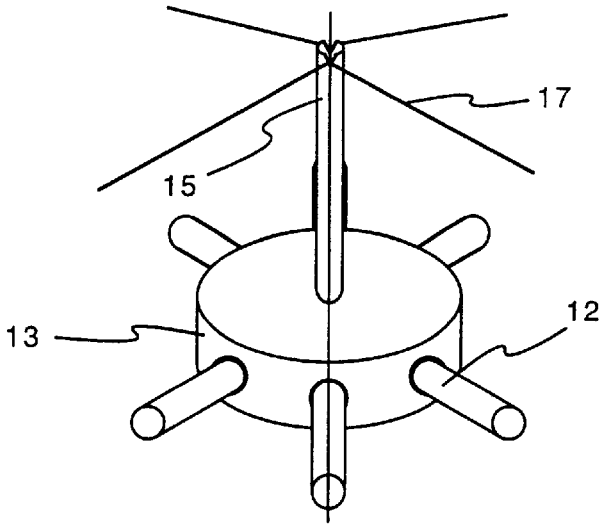
FIGS. 4 and 5 are views of hub means designs.
Figure 5:
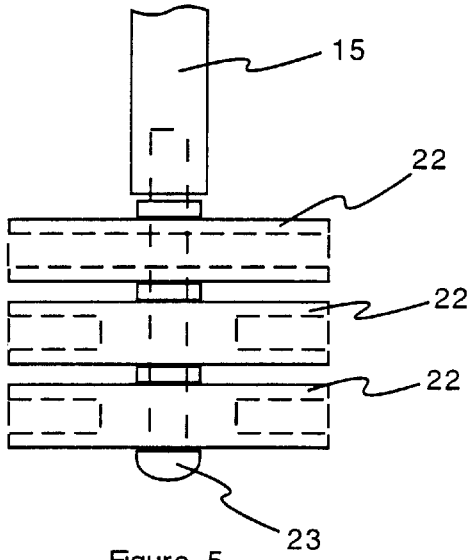

FIGS. 4 and 5 show various hub means 13 for joining the frame member means at the crossing point of the frame members. The section for connecting the members 12 may be a single piece having holes allowing the frame member means to pass through or terminate in the hub as shown in FIG. 4. FIG. 5 shows a hub having a plurality of sections 22 allowing passage or termination of the frame member means. These sections, round or surfaces having passages for frame members, may be joined together with such means for connecting such as screws, bolts, or other supporting devices 23 and shaped to contain the frame member means. The sections may be permanently joined forming a single shape 13 or allowed to individually rotate into position.

The hub means provides a preferably approximate perpendicular upward projection means 15 for producing an airfoil shape in the surface material. This projection means may be integral with the hub or a separate means attached to the hub. The height of the hub produces an airfoil shape that aids in flying the kite. The long thin connecting means cross on top of the projection and the means 28 for retaining these connecting means includes notches, loops, circles, or wires. The hub should be centrally located in a forward position from the center of the kite to achieve the best aerodynamic shape. Tests showed that positioning the hub means in the center position of the kite produced poor flying. Moving the hub means forward appreciably increased the flying ability under the same wind conditions and showed that the airfoil design is effective. The airfoil design has a short sharp increasing curve in the upper part and a tapering longer curve on the lower part of the kite's flexible material means. A three feet by five feet rectangular kite has the hub centrally located about 10 inches from the top (26 inches from the bottom) and having a projection height of 8 inches although other heights and distances may be used depending upon the size and weight of the kite, the wind velocity, and air density. Kites having an airfoil design and a size of 8 feet by 5 feet have been flown.

Figure 6:
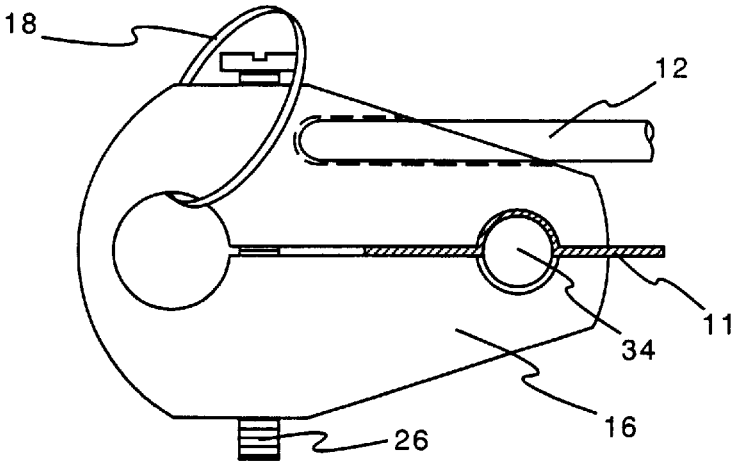
FIGS. 6 and 7 are views of clamp means designs.
Figure 7:
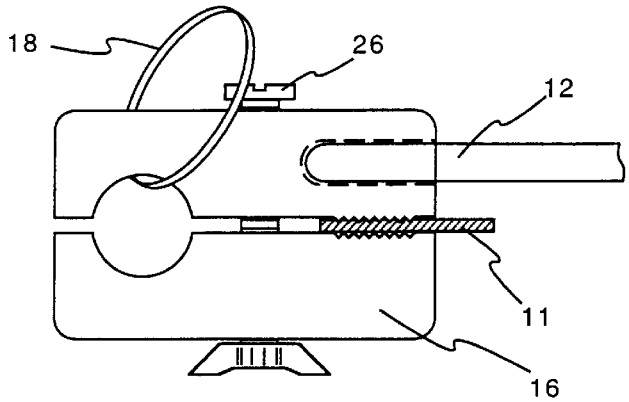

Two means 16 for joining the surface material means to ends of the frame member means, clamps, are shown in FIGS. 6 and 7. U.S. Pat. Nos. 1,943,020; 2,452,406; 3,034,187 and 3,986,746 teach clamping mechanisms that may be modified to attach support members means to surface material means. One modification of these patents is a mechanism shown in FIG. 6. The clamp means 14 has an opening for insertion of a frame member means 12. An opening allows attachment of the long thin connecting means 17 for providing a tension. Any clamp means using a rough surface, grooves, or non-skid materials to contact and maintain the surface means 11 is secured by a means for applying a clamping force 26 such as screws, clamps, nuts and bolts, wedges, or levers. A small dowel 34 may be included in the clamp jaws to better maintain the flexible material means in the clamp by introducing a change of direction and provide more clamping area. Another clamp design is shown on FIG. 7 where the clamp mating pieces are joined together with a single fastening means such as a screw, bolt, or clamp. Other more permanent means for attaching the material means to the ends of the frame member means include screws, nuts and bolts, wedges, wires, ties, or levers.

Figure 8:
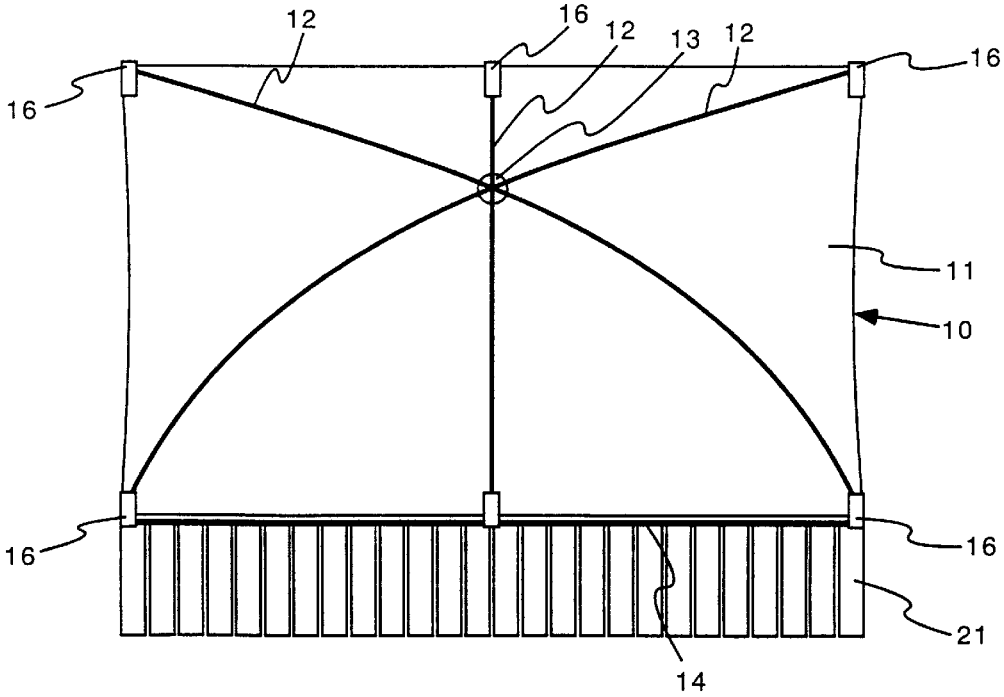
FIG. 8 shows a kite having a rigid preformed airfoil shape of a multisided material and a frame.

FIG. 8 shows a top view of a preformed airfoil shape on a multisided rigid material means 11 for forming a flying surface. The plurality of frame means 11 may be added for additional strength and rigidity during flying. This plurality of frame means may be centrally connected through a hub means 13 for maintaining the frame position. This hub means may be just wires, clamps or as previously described but without an upper member to form the airfoil. With the use of the preformed airfoil shape, the airfoil shape is formed without the protrusion or projection. A means 16 for attaching and maintaining the frame on the multisided material means such as clamps or previously stated means may be used. The thin connecting means are not necessary on this embodiment. A bridle means 33 for controlling the kite is positioned on the kite on the opposing surface from the frame means.

The multisided material means 11 may have a thermally formed airfoil on a thin lightweight thermoplastic material with or without reinforcing or additives such as fiberglass, carbon or particles providing rigidity. These plastics include polypropylenes, and PVC. Thermosetting plastics with or without reinforcing or additives for rigidity such as polyamides, polyesters and other polymers may also be used to make preformed airfoils. With a formed and partially formed airfoil, the frame means may aid in the formation of the airfoil when attached to the multisided material means in addition to maintaining the shape during flying.

From the above description of the invention, various changes and modifications to the apparatus and method will occur to those skilled in the art. All such modifications coming from within the scope of the amended claims are intended to be included therein.

I claim:

1. A kite comprising:

(a) interchangeable multisided material means for forming a flying surface;

(b) frame means for maintaining the multisided material means in said flying surface form by supporting opposing corners and upper and lower center of said multisided material means;

(c) centrally forward position located hub means for joining each the frame means and having an upward projection means for forming a curve airfoil shape of the frame means and said multisided material means whereby the projection height and forward position produce a stationary curved airfoil shape that aids in flying said kite in various wind conditions;

(d) clamping means for releasably attaching and maintaining the multisided material means to the frame means ends;

(e) long thin connecting means in tension for forming the airfoil shape by the frame means, connected to diagonally opposing the attaching means, and crossing on the top of the hub means projection means; and (f) bridle means attached to the opposing side of the kite frame means for controlling the kite wherein the multisided material means is releasable from the clamping means and interchangeable without disassembly of the frame means and connecting means.

2. A kite as recited in claim 1 wherein the multisided material means for forming a flying surface has four sides.

3. A kite as recited in claim 1 wherein the multisided material means for forming a flying surface requires no modification to attach the means for attaching and maintaining to the material means.

4. A kite as recited in claim 1 further comprising an additional peripheral support of the material means connected to the frame means ends.

5. A method of making a kite comprising:

(a) providing a multisided material means for forming a flying surface;

(b) maintaining the multisided material means in the flying surface form by supporting opposing comers and upper and lower center of the multisided material means with frame means and;

(c) positioning the frame means into a centrally forward position located hub means for joining the frame means, the hub means having an upward projection means for forming a curve airfoil shape of the frame means and the multisided material means whereby the projection adjustable height and forward position produce an adjustable stationary airfoil shape that aids in flying the kite in various wind conditions;

(d) clamping the multi-side material to the frame means ends for attaching and maintaining said multisided material means to the frame means ends;

(e) attaching a plurality of long thin connecting means in tension for forming the curved airfoil shape by the frame means, connected to diagonally opposing the attaching means, and crossing on the top of the hub means projection means; and (f) attaching a bridle means to the kite frame means for controlling the kite, wherein the multi sided material means is releasable from clamping means and interchangeable without disassembly of the frame means and connecting means.

6. A method of making a kite as recited in claim 5 wherein the multisided material means for forming a flying surface, having four sides.

7. A method of making an adjustable kite as recited in claim 5 wherein the multisided material means for forming a flying surface requires no modification to attach the means for attaching and maintaining to the material means.

8. A method of making a kite as recited in claim 5 further comprising adding a peripheral support of the material means connected to the frame means ends.

* * * * *